US005464572A

United States Patent [19]

Bonzi

[11] Patent Number: 5,464,572

[45] Date of Patent: Nov. 7, 1995

[54] DEVICE FOR HUMIDIFYING AND IONIZING AIR

[76] Inventor: Mario Bonzi, Via Rovigo, 31 Brescia, Italy

[21] Appl. No.: 200,329

[22] Filed: Feb. 23, 1994

[30] Foreign Application Priority Data

Mar. 4, 1993 [IT] Italy ..... MI93A0416

[51] Int. Cl.[6] ..... B01F 3/04; B03C 3/00; H01T 23/00

[52] U.S. Cl. ..... 261/30; 261/DIG. 4; 261/DIG. 48; 250/324; 250/325; 361/231; 361/232

[58] Field of Search ..... 261/DIG. 48, DIG. 4, 261/30; 250/324, 325, 326; 361/230, 231, 232

[56] References Cited

U.S. PATENT DOCUMENTS

| | | | |
|---|---|---|---|
| 2,905,454 | 9/1959 | Wood | 261/30 |
| 4,031,171 | 6/1977 | Asao et al. | 261/DIG. 48 |
| 4,563,313 | 1/1986 | Tsuaki | 261/DIG. 48 |
| 4,686,069 | 8/1987 | Hahne et al. | 261/92 |
| 4,746,466 | 5/1988 | Takahashi | 261/30 |
| 4,752,422 | 6/1988 | Uchida et al. | 261/DIG. 48 |
| 4,906,417 | 3/1990 | Gentry | 261/30 |
| 4,980,796 | 12/1990 | Huggins | 361/231 |
| 5,055,963 | 10/1991 | Partridge | 361/231 |

FOREIGN PATENT DOCUMENTS

| | | | |
|---|---|---|---|
| 0206171 | 12/1986 | European Pat. Off. . | |
| 61-24930 | 2/1986 | Japan | 261/DIG. 48 |
| 1-312336 | 12/1989 | Japan | 261/DIG. 48 |
| 4-48946 | 2/1992 | Japan . | |
| 6-26677 | 2/1994 | Japan | 261/DIG. 48 |
| 420360 | 11/1934 | United Kingdom | 361/231 |

OTHER PUBLICATIONS

Patents Abstract of Japan–vol. 16, No. 234 (C–0945) 29 May 1992 & JP–A–04048 946 (Toshiba) 18 Feb. 1992–abstract.

*Primary Examiner*—Khanh P. Nguyen
*Attorney, Agent, or Firm*—Guido Modiano; Albert Josif

[57] ABSTRACT

A device for humidifying and ionizing air includes a first chamber for humidifying the air, a second chamber, which is separate from the first chamber, for ionizing the air, and means for aspirating and expelling the air through the two chambers, keeping the streams of ionized air and of water vapor separate.

16 Claims, 1 Drawing Sheet

DEVICE FOR HUMIDIFYING AND IONIZING AIR

BACKGROUND OF THE INVENTION

The present invention relates to a device for humidifying and ionizing air, particularly for domestic use.

As is known, various types of air humidifiers for domestic use are commercially available; one of them is the ultrasonic humidifier. This humidifier exploits the natural phenomenon of forced evaporation of water when it is forced to resonate at a certain frequency (approximately 1.7 MHz). In known devices, the water is in contact with an ultrasound source, usually a piezoelectric transducer driven by an electronic oscillator, so as to make the transducer vibrate at the intended frequency. When this frequency is brought to approximately 1.7 MHz, the transducer causes the water molecules to vibrate, increasing their kinetic energy and allowing them to pass beyond the surface of the water, thus creating an evaporation effect.

A drawback of known humidifiers, and of electronic devices in general, is that, during the operation of the transducer driven by the oscillator, said oscillator is heated due to its internal resistance. To allow normal operation of the oscillator (and of the other electronic components) and prevent damage thereof due to excessive temperature, the oscillator has a heat sink made of metal (usually aluminum). Since heat dissipation is proportional to the surface of the heat sink, the device requires a rather large heat sink, thus increasing the bulk of the humidifier. The same drawback is found in the electronic circuits of known ionizers.

Furthermore, as is known, ionizers of different kinds are available on the household-appliance market. Ionizers use another natural phenomenon, which is the ionization of air molecules when they are in contact with an electrode which has a high negative-polarity electrical potential (5000–6000 V). The amount of air ionization is a function of the potential of the electrode. If the potential exceeds a certain value, one obtains the unwanted effect (Corona effect) of producing ozone. Ozone production is undesirable because less ions are produced if ozone is formed and because ozone has recently been considered harmful to the health.

The efficiency of ionization, i.e. the number of ions produced in a given time interval, is lower in a humid environment, since the water molecules are ionized, causing a drop of voltage at the ionization electrode due to the conductance of the water vapor in the air. Furthermore, very humid air is more suitable for ozone forming due to the Corona effect, which produces sparks.

Thus, if the user wishes to have a humidifier and an ionizer in the same room, he must keep them far apart in order to avoid negative ozone-forming effects and produce a sufficient number of ions. As an alternative, the user can keep the two appliances close to each other and operate them alternately.

Furthermore, this situation entails the need to have two clearly distinct appliances with a power outlet for each one.

SUMMARY OF THE INVENTION

A principal aim of the present invention is to provide a single device for humidifying and ionizing air.

An object of the invention is to eliminate the problem of low ionization efficiency during simultaneous operation of the humidifier and of the ionizer close to each other.

Another object of the invention is to eliminate the possibility of creating sparks due to the Corona effect when ionization occurs in a very humid environment.

A further object is to provide efficient cooling of the electronic components and particularly of the oscillator for driving the piezoelectric transducer.

With this aim, these objects and others in view, which will become apparent hereinafter, there is provided, according to the present invention, a device for humidifying and ionizing air, as defined in the accompanying claims.

BRIEF DESCRIPTION OF THE DRAWINGS

The characteristics and advantages of the invention will become apparent from the following detailed description of a preferred but not exclusive embodiment thereof, illustrated only by way of non-limitative example in the accompanying drawings, wherein.

DESCRIPTION OF THE PREFERRED EMBODIMENTS

Figures 1, 2:
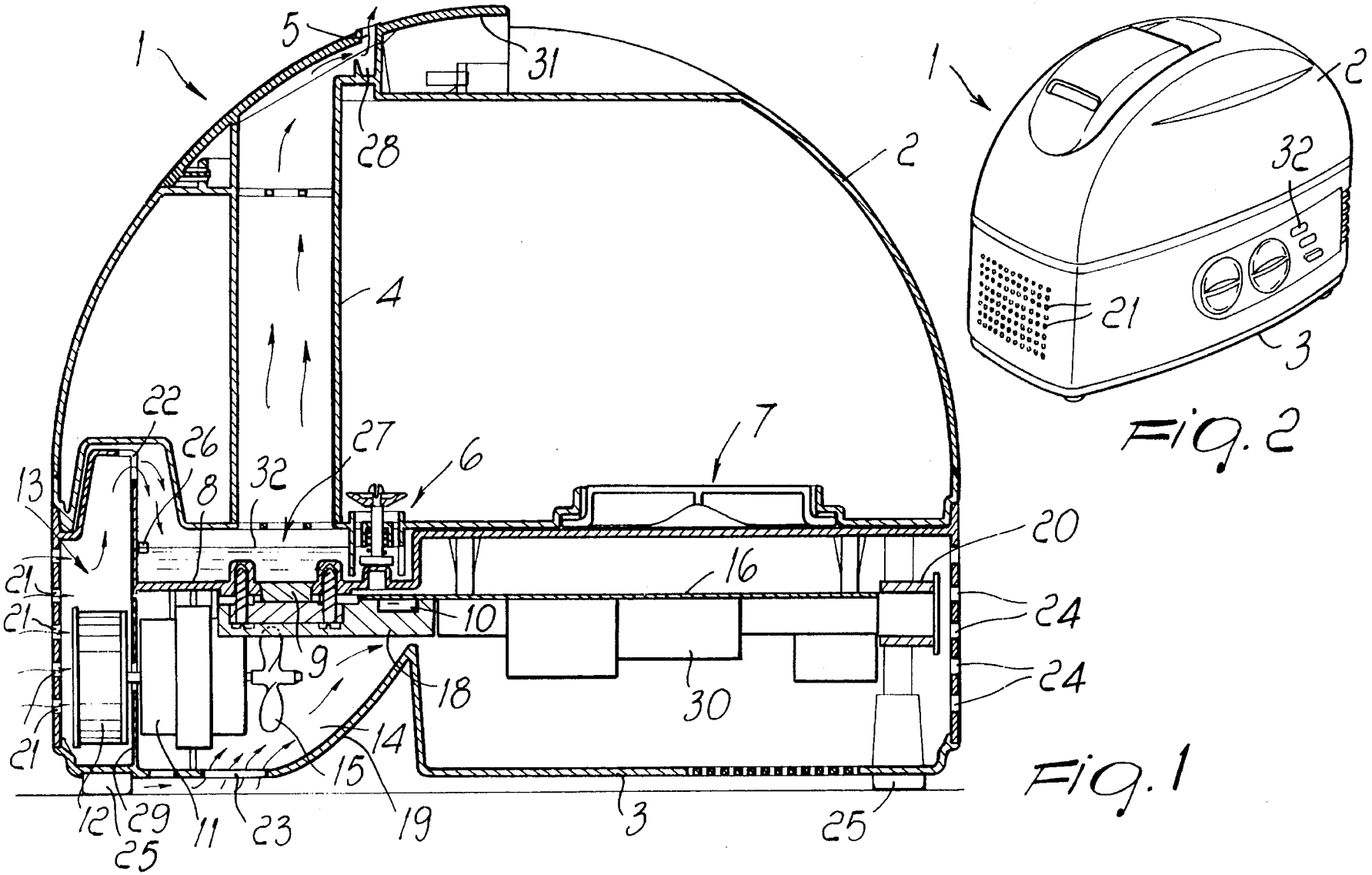
FIG. 1 is a sectional view, taken along a vertical plane, of the device according to the present invention.
FIG. 2 is a perspective view of the device according to the present invention.

With particular reference to FIG. 1, the reference numeral 1 designates the device according to the invention, which is composed of two main parts: the first one is a dome-shaped water container 2, and the second one is the base 3 of the device. Inside the container 2 there is a vapor duct 4 which allows air and vapor to flow from the end of the container which is coupled to the base 3 of the device toward the outside of the container. At the end of the duct 4 there is an orientation nozzle 5 for the outgoing water vapor. The nozzle can be fixed or articulated onto the container to allow adjustment of the direction of the outgoing water vapor. A tray 28 for essences is provided below the nozzle 5 and inside the duct 4.

A level control valve 6 is provided proximate to the end of the duct 4 which is coupled to the base 3. A plug 7 is also provided on the same surface to allow for the filling, of the container 2, with water.

A cavity is present on the upper surface of the base 3, and is located at the opening of the duct 4 and at the valve 6; said cavity forms a tray 8 for containing the evaporation water. A piezoelectric transducer 9, driven by an oscillator 10, protrudes from the bottom of the tray 8 by means of an opening. The transducer is driven by the oscillator at an ultrasonic frequency and causes the water molecules in the tray 8 to oscillate, causing their evaporation. A sensor 26 is also provided in the tray to detect whether the level of the water 32 in the tray has dropped below a preset value. The sensor is suitable to be connected to an alarm device which switches off the appliance when the water in the tray drops below a certain level. Furthermore, the alarm device switches on an indicator 32 (FIG. 2) that can be seen from the outside of the appliance and issues an acoustic signal, by means of a known acoustic device, to warn the user. The lower surface of the container 2 is completely in contact with the base 3, except for a portion which is located above the tray 8, forming a water vapor chamber 27.

Below the tray 8 and inside the base 3 there is a motor 11 that has a through shaft with two fans associated with each end of the shaft. The first fan 12 is of the vane type and is located in a first chamber 13 which is separated by a wall 29 from the second chamber 14 where the motor 11 is located.

The second fan 15 is an axial fan and is located at the other end of the shaft. The part of the transducer which is not immersed in the water of the tray and the electronic components 30 of the device are inside the second chamber 14. The electronic components 30 are provided on one or more printed circuits 16. Among these components, the driving oscillator 10 is associated with a heat sink 18. An air baffle 19 is formed on the bottom of the second chamber 14 and is arranged so as to direct the air stream of the axial fan 15 toward the heat sink 18.

The ionization electrodes 20 associated with the printed circuit 16 are present at the other end of the second chamber 14.

The first chamber 13 comprises first intakes 21, on the outer wall of the chamber, through which air is drawn in by the vane fan 12. A delivery grille 22 is present on the upper wall of the first chamber 13 and in contact with the water vapor chamber 27, and allows the air stream produced by the vane fan 12 to flow from the first chamber 13 to the water vapor chamber 27.

The second chamber 14 has one or more second inlets 23 located on its bottom and interposed between the motor 11 and the air baffle 19, and has outlets 24 located on the outer wall of the second chamber 14 which is opposite to the wall containing the first inlets 21 and proximate to the ionization electrodes 20.

In order to allow air to enter through the second inlet or inlets 23, the base 3 has spacer elements 25 which keep the base 3 spaced from the surface on which it rests.

The device furthermore has a handle 31 to facilitate its transport.

Operation of the device according to the invention is as follows. When the appliance is switched on, the motor 11 rotates the fans 12 and 15 so as to draw air in through the inlets 21 and 23. The piezoelectric transducer 9 is driven by the oscillator 10 at an ultrasonic frequency of approximately 1.7 MHz. The vibration of the transducer immersed in the water of the tray 8 causes the evaporation of the water molecules, producing a concentration of water vapor inside the water vapor chamber 27. The air drawn in by the vane fan 12 is pushed, through the delivery grille 22, into the chamber 27, and forces the expulsion of the water vapor through the duct 4. The nozzle 5 directs the vapor stream, in a direction away from the outlets 24, preferably upward. The inclination of the nozzle 5 must not be such as to allow aspiration of the expelled water vapor by means of the fans 12 and 15. The water vapor stream can furthermore be perfumed, before being expelled, by passing over the tray 28 that contains the essences.

Since the water in the tray 8 evaporates continuously, the water level tends to decrease. The level control valve 6 supplies water, from the container 2, into the tray 8, and maintains a constant water level. If the container 2 is empty, the water level in the tray 8 drops below an emergency level, activating the sensor 26 which switches off the oscillator 10, thus avoiding overheating of the transducer 9, which is cooled with the water contained in the tray.

At the same time, a high-voltage generator present on the printed circuit 16, advantageously a voltage multiplier, raises at least one of the ionization electrodes 20 to a suitable potential for efficient air ionization (approximately 5000–6000 V). The axial fan 15 draws air into the second chamber 13 through the intakes 23 formed on the bottom of the base 3. The baffle 19 directs the stream of air toward the heat sink 18 associated with the oscillator 10, cooling it. The stream of air in the second chamber passes across the remaining electronic components, maintaining their operating temperature, too, at an intended level. Finally, the air stream passes next to the ionization electrodes 20. Since the air of the stream is drawn from the bottom of the appliance and the nozzle 5 directs the water vapor upward, the air of the stream which is ionized is dry enough to allow efficient ionization. After passing next to the electrodes 20, the stream containing the ionized air is expelled through the outlets 24.

Therefore, the water vapor stream is kept thoroughly separate from the stream of ionized air, allowing air humidification and ionization within a single enclosure.

The device furthermore comprises activation means which allow to activate or switch off both the humidifying part and the ionizing part of the device, leaving the other part on.

Another advantage of the present invention is that there is no wiring between the container 2 and the base 3. Accordingly, the container can be fully separated from the base 3 when it is lifted to fill it with water.

The invention thus conceived is susceptible to numerous modifications and variations, all of which are within the scope of the inventive concept.

Finally, all the details may be replaced with other technically equivalent ones.

In practice, the materials employed, as well as the shapes and dimensions, may be any according to the requirements without thereby abandoning the protective scope of the following claims.

I claim:

1. Device for humidifying and ionizing air, wherein it includes a first chamber (13) for humidifying air, and a second chamber (14) for ionizing air, said first chamber (13) and said second chamber (14) being separated from each other by a wall (29), means (8, 9) for humidifying air, located in said first chamber (13), means (20) for ionizing air, located in said second chamber (14), first means (11, 12) for aspirating and expelling a first stream of air through said said first chamber (13) and second means (11, 15) for aspirating and expelling a second stream of air through said second chamber (14), said wall (29) keeping said first stream and said second stream separate from each other.

2. Device according to claim 1, wherein said first means for aspirating and expelling a first stream of air is constituted by a vane fan (12), a motor (11), said vane fan (12) being mounted on one end of a shaft of said motor(11), said shaft passing through the wall (29) dividing said first (13) and second (14) chambers.

3. Device according to claim 2, wherein said second means for aspirating and expelling a second stream of air is constituted by a fan (15), a motor (11), said fan (15) being mounted on the other end of the shaft of said motor (11).

4. Device according to claim 2, wherein said first stream of air is aspirated by said vane fan (12) through first intakes (21).

5. Device according to claim 3, wherein said second stream of air is aspirated by said fan (15) through second intakes (23).

6. Device according to claim 1, wherein a water vapor chamber (27) is disposed adjacent to and in communication with said first chamber (13) and contains transducer means (9) immersed in the water contained in said chamber (27) for causing eyaporation of the water.

7. Device according to claim 6, wherein it comprises means (26) for detecting the level of the water inside said chamber (27), said means being connected to alarm means suitable to switch off the device when the water is below a certain level.

8. Device according to claim 6, wherein said transducer means (9) is constituted by a piezoelectric transducer driven by an oscillator (10).

9. Device according to claim 1, wherein it comprises electronic components (30) inside said second chamber (14) which are cooled by said second stream of air.

10. Device according to claim 9, wherein said second chamber (14) has an air baffle (19) to direct said second stream of air towards said electronic components (30).

11. Device according to claim 1, wherein said means for ionizing air are high-voltage electrodes (20).

12. Device according to claim 1, wherein said first chamber (13) has a tray (28) containing essences to perfume said first stream of humidified air.

13. Device according to claim 1, wherein said first stream of humidified air is conducted through a vapor duct (4) oriented vertically and exits through an opening (5) disposed at the top of the apparatus.

14. Device according to claim 1, wherein said second stream of ionized air exits through outlets (24), which direct said second stream of air horizontally.

15. Device according to claim 13, wherein said opening (5) for the expulsion of the humidified air is constituted by a nozzle orientable as desired.

16. Device according to claim 1, wherein it comprises a water container (2) which is detachable from the apparatus, to facilitate the filling of said container (2).

* * * * *